US005944586A

United States Patent [19]

Sevigny et al.

[11] Patent Number: 5,944,586

[45] Date of Patent: Aug. 31, 1999

[54] APPARATUS AND METHOD FOR CLEANING AND FINISHING

[75] Inventors: Claude Sevigny, Laval, Canada; David M. Hornby, Sussex, Wis.

[73] Assignee: Meguiar's Inc., Irvine, Calif.

[21] Appl. No.: 09/075,051

[22] Filed: May 8, 1998

Related U.S. Application Data

[60] Provisional application No. 60/046,110, Apr. 9, 1997.

[51] Int. Cl.[6] ..... B24B 29/00

[52] U.S. Cl. ..... 451/57; 451/461; 451/359; 451/523; 451/490

[58] Field of Search ..... 451/57, 461, 344, 451/353, 359, 527, 529, 530, 537, 523, 524, 516, 548, 504, 507, 486, 490; 15/105, 244.4

[56] References Cited

U.S. PATENT DOCUMENTS

| | | | |
|---|---|---|---|
| 2,121,384 | 6/1938 | Gray | 15/105 |
| 4,484,419 | 11/1984 | Freerks | 451/450 |
| 5,389,032 | 2/1995 | Beardsley | 451/359 |
| 5,846,123 | 12/1998 | Brown et al. | 451/523 |

FOREIGN PATENT DOCUMENTS

| | | | |
|---|---|---|---|
| 1097572 | 4/1989 | Japan | 451/523 |
| 001440679 | 11/1988 | U.S.S.R. | 451/533 |

*Primary Examiner*—Robert A. Rose

*Attorney, Agent, or Firm*—Ashen & Lippman

[57] ABSTRACT

Apparatus and method for both cleaning and polishing work surfaces such as automotive panels using a single combination pad. In one embodiment, a support holds a circular replaceable, disposable cleaning/polishing pad on a powered polishing tool for rotation about the pad's central axis. The illustrated pad is made of compressible/expandable material such as foam. The pad has front and rear recesses that define concentric radially outer and inner sections. The inner section is thinner and has a forward cleaning surface. The outer section normally protrudes forwardly of the cleaning surface so that when it is first brought into engagement with a work surface, the cleaning surface does not engage the work surface. A pressure-applying backup plate of a firm material such as neoprene has a forwardly displaced inner portion that is received in the pad rear recess for applying firm pressure to the pad cleaning surface. The plate has an outer portion for applying pressure to the outer pad section. In operation, the pad is positioned at the work surface and then rotated. The backup plate applies sufficient force to initially axially compress the outer pad section and position the cleaning surface at the work surface. Further force acts through the backup plate inner portion to apply firm distributed cleaning action by the cleaning surface against the work surface to remove the amount of material desired. Then the axial force is reduced to allow the pad outer section to expand and move the cleaning element out of engagement with the work surface. This allows the rotating foam outer section to be used to engage and polish the cleaned area of the work surface.

25 Claims, 3 Drawing Sheets

FIG. 7
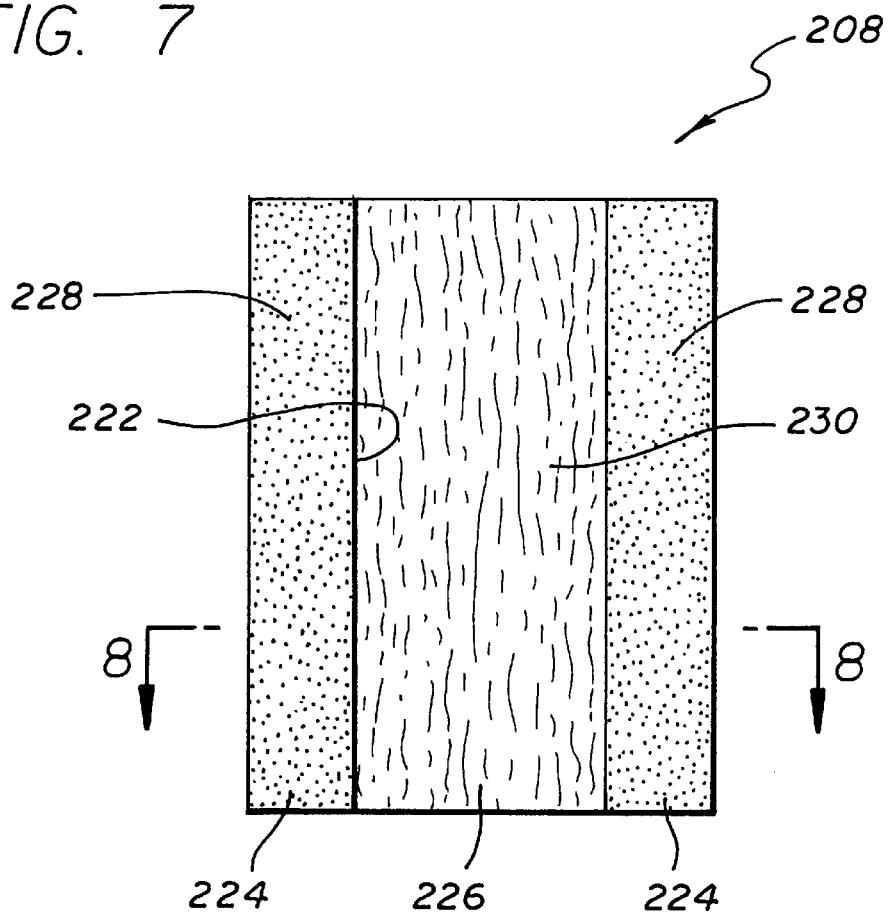
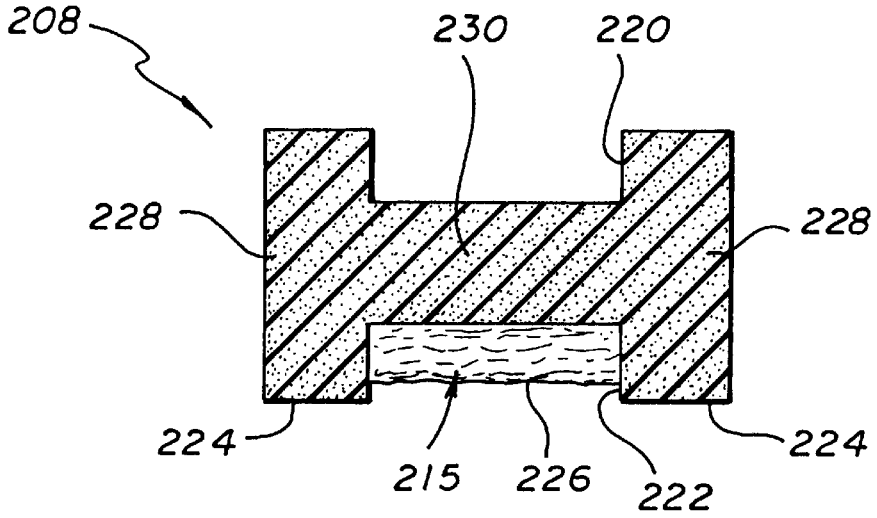
FIG. 8

APPARATUS AND METHOD FOR CLEANING AND FINISHING

RELATED APPLICATION

This application is based on and claims priority under 35 U.S.C.120 of U.S. Provisional patent application Ser. No. 60/046,110, filed Apr. 9, 1997.

FIELD OF INVENTION

Apparatus and method for cleaning and polishing work surfaces such as painted automotive panels.

BACKGROUND OF INVENTION

A common operation for buffing various surfaces was to first use a commercially available wool or foam cleaning surface to remove imperfections from the surface, and to then switch to a foam surface for final polishing operation.

More particularly, when repainting or refinishing a surface such as a panel of an automobile or the like, it is common practice to remove imperfections such as dust nibs, runs and sags using ultra-fine sandpaper. This, however, leaves fine sandpaper scratches which give the painted finish a dull look. The current practice to remove these sandpaper scratches is to first clean (also know as compounding, removing or cutting) the scratched area by use of a rubbing compound and a cleaning surface such as a sheepskin mounted on a powered polishing tool. This requires that substantial and well-distributed pressure be applied to the cleaning surface and that a significant amount of material be removed from the work surface. The operation is then completed by polishing the cleaned area as with a foam polishing surface. Heretofore, in usual practice, two separate polishing tools were inter changeable used or the cleaning surface was removed from the polishing tool and replaced with a polishing surface. The constant changing was undesirable for various reasons including cost and inefficiency.

U.S. Pat. No. 5,389,032 by Beardsley discloses one attempt to provide for this need. It discloses an abrasive article which has a pair of concentric abrasive surfaces, a circular inner surface or layer 28 recessed back from a ring-shaped annular outer surface or layer 24. As shown in the drawings, inner layer 28 is affixed to a thinner circular inner support portion 22 of a less compressible material, and annular outer layer 24 is affixed to an annular thicker outer support portion 20 of a more compressible material. Both support portions 20, 22 are affixed to a pad 12 represented in the drawings as a porous or foam or material. The pad 12 includes means for connecting to an abrading apparatus 18. That connecting means appears in the drawings to constitute a plate of metal or other solid material that extends fully across the rear surface of the foam pad 12.

While such a continuous flat plate extending across the full width may operate satisfactorily for some applications, it has been found by applicant that such a structural arrangement will not concentrate force on a central inner cleaning surface so as to provide efficient removal or cleaning away when there is a desire to remove significant amounts of material from a work surface.

SUMMARY OF THE DISCLOSURE

The illustrated apparatus includes a single combination cleaning and polishing pad that saves the operator from having to change from one pad to another during the polishing operation.

One form of illustrated pad is generally disk-shaped, having a central axis of rotation. It is made of a compressible and expandable material such as foam. The pad has a front and rear circular center recesses that form concentric radially outer and inner pad sections. The inner pad section is thinner and may have a cleaning element of sheepskin or the like fixed to its axially forward face to provide a cleaning surface. The cleaning surface is thereby disposed within the front recess. The outer pad section is sufficiently thicker so that when it initially engages a working surface, the cleaning surface in the recess does not engage the work surface.

The pad rear recess receives a mating generally flat disk-shape pressure-applying portion of a backing plate. Attachment means on the pressure member and on the recess inter-connect to releasibly but securely lock the pad to the backing plate for common rotation. The backing plate is in turn secured for common rotation to a motorized polisher or the like.

In operation, cleaning compound may be applied to the cleaning surface or to the work surface to be cleaned, and the pad may be positioned adjacent to work surface with the outer surface abutting or at least in close proximity to the work surface. The polisher is then turned on. Then sufficient forward axial pressure is exerted by the backing plate to compress the outer pad section to move the cleaning surface to the work surface. Further axial pressure from the inner backing portion forces the cleaning surface into firm distributed cleaning engagement with the work surface, to achieve desired cleaning or material removal as the pad is rotated. After the cleaning is completed, the axial force is reduced sufficiently to allow the outer pad section to expand and thereby move the cleaning element out of engagement with the work surface. This allows the rotating foam outer section then to be used to engage and polish the cleaned area of the work surface.

Thus, both the cleaning and polishing operation may be achieved with the same pad, and in a very short period of time without having to change machines or adding or removing surfaces to a single machine.

The method of manufacture of the form of pad just described is also a portion of the present invention. This method, which is illustrated and described in detail below, is generally as follows: a thin generally cylindrical piece of foam material that has opposed generally flat circular axially forward and rearward faces is held in place. Then a first generally circular recess is ground concentrically in the center of the axially rearward face of the pad. After that, a second a generally circular recess is ground concentrically in the center of the axially forward face of the pad.

This process produces very accurate and desirable cylindrical recesses whose sides are parallel to the center axis of the disk and whose bottom surfaces are flat and at 90 degrees to the central axis and the side walls. In particular, this provides for a very good mating fit with the circular disk-shaped cleaning element for an even and symmetrical distribution of cleaning force across the face of the cleaning element. While alternative methods of cutting foam such as hot wire cutting are less complicated and less costly, they produce a much less exact finish, where the surfaces tend to be inclined rather than a right angles to one another, with adverse consequences to the final pad product.

BRIEF DESCRIPTION OF THE DRAWINGS

FIG. 7 is a plan view from the front of another alternative form of pad.

FIG. 8 is an enlarged sectional view taken generally along Line 8—8 of FIG. 7.

DETAILED DESCRIPTION OF THE PREFERRED EMBODIMENT SHOWN IN THE DRAWINGS

Figure 4:
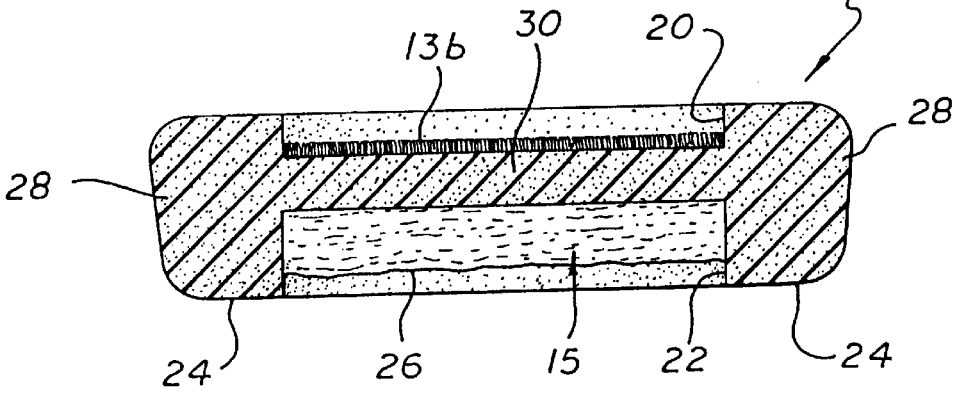
FIG. 4 is a side view of the cleaning/finishing pad.
Figure 5:
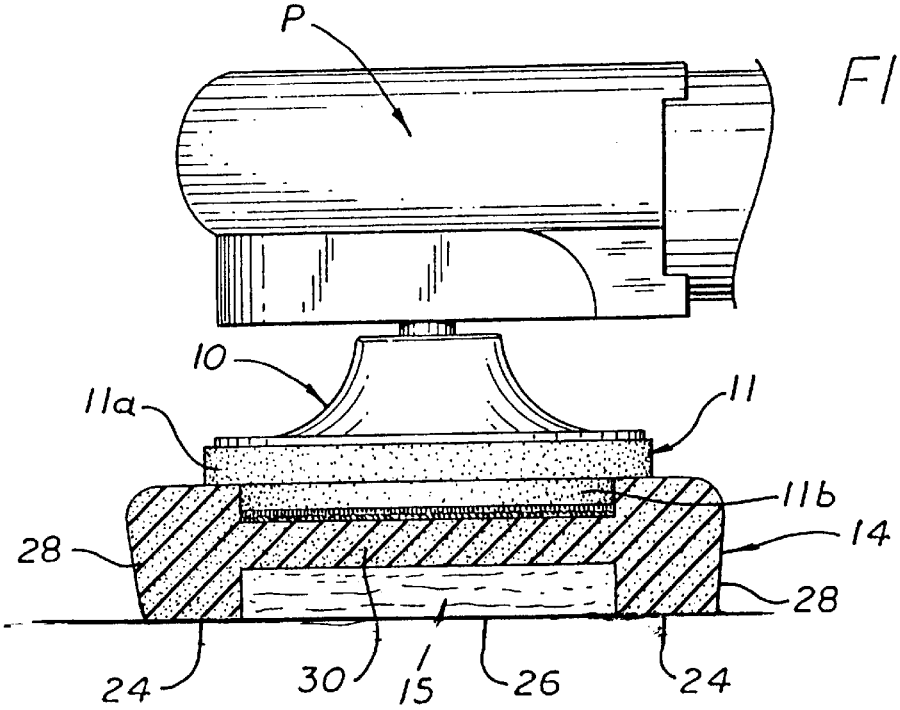
FIG. 5 is a side view of the cleaning/finishing pad engaging a work surface with sufficient axial force being exerted on the pad to compress the outer section and move the inner cleaning element into cleaning contact with the work surface.

FIGS. 1 through 5 illustrate a presently preferred embodiment 8 of the invention in the form of a cleaning/finishing pad 14 and a pressure-applying backing plate 10. The pad 14 is removably mounted on the backing plate 10, which in turn is adapted to be mounted on a standard automotive type polisher P (FIG. 5). The polisher P rotates the backing plate 10 and the pad 14 about their common axis of rotation R—R. The backing plate 10 may also be adapted to be used on a D.A. (dual action) sander (not shown). Such drive units include electric polishers that operate between about 1,000 to 3,000 R.P.M.'s, air operated polishers that operate between about 1,000 and 5,000 R.P.M.'s, and Dual Action polishers that operate up to about 10,000 O.P.M.'s.

For convenience of description, the cleaning and polishing surfaces which face the work piece will be described as facing in the forward direction, and the opposite side of the pad which connects to the backing plate will be described as facing in the rear direction. It will be understood that the apparatus may be used in virtually any orientation depending on the orientation of the work surface which is being cleaned and finished.

The illustrated backing plate 10 has a flat disk-shaped axially forward portion or base 16. It also has a somewhat frusto-conically shaped centered, rearwardly extending hub portion 18. The hub portion 18 has a central opening 19 for receiving and securing to the output shaft of the polisher P. Suitable means may be provided for locking the shaft of the polisher to the hub portion 18 such as one or more set screws (not shown). The backing plate 10, may be made of any suitable material such as molded plastic, metal or the like.

The front face of the backing plate 10 base portion 16 is permanently secured to the rear face of a generally disk-shaped pressure-applying member or portion 11. Pressure-applying member 11 may be made of a firm but resilient material such as a relatively soft neoprene rubber. The illustrated pressure-applying member 11 is formed with a pair of axially forwardly directed pressure-applying planar surfaces, an outer surface 12*a* and an inner surface 12*b*. More particularly, the illustrated inner surface 12*b* is a generally planar circle. Inner surface 12*b* is stepped or offset axially forwardly of the outer surface 12*a*, which is an annular forwardly facing generally planar ring disposed radially outwardly of the inner surface 12*b*.

The illustrated member 11 has a forwardly projecting or stepped inner portion 11*b* that provides the inner pressure-applying surface 12*b* at its forward face. The remainder 11*a* of the illustrated member 11 rearwardly of the inner portion 11*b* lies behind and extends radially outwardly around the inner portion 11*b* to provide the outer pressure-applying surface 12*a* at its forward face. The member 11 may be a single molded or machined piece of material or may be constructed of two or more pieces of the same or different materials, to achieve the desired functionality.

In illustrated apparatus, a hook/loop type fastener layer or face 13*a* is permanently attached to the illustrated inner surface 12*b*.

FIG. 4 illustrates the cleaning/finishing pad 14. The pad 14 is preferably one to two inches thick. It may be manufactured from a material that is relatively strong, tough and resistant to oils, solvents and the like, that is compressible and expandable, and that provides a good buffing or polishing surface. The presently preferred material is reticulated polyurethane foam. A pre-polymer foam may also be used. Such pads have a usual life of a day or so (approximately 30–50 cars), and they are then replaced and disposed of. As discussed more fully below, the pad may be made one a single piece of material or two or more pieces of the same or different materials, to achieve the desired functionality.

The back of the pad 14 has a central recess 20 proportioned to receive the pressure-applying front portion 11*b* of the member 11 with pressure-applying inner-surface 12*b* engaging the rear facing bottom surface 20*a* of the recess 20. This recess 20 extends across a major portion of the diameter of the pad 14, and is preferably generally coextensive with the area of the cleaning element 15. It is generally preferred that the pad rear recess 20 and the matting backing portion 11*b* be generally symmetrical about the central axis to promote stable uniform rotation. In the regard, they are illustrated in apparatus 8 as being circular. It may be desired in some instances or applications that these elements have other shapes such as square, oblong, etc.

In the illustrated apparatus 8, a loop/hook fastener face 13*b*, which is permanently fixed to the bottom surface 20*a* of the recess 20, releasibly engages the loop/hook fastener face 13*a* on the pressure-applying member surface 12*b* to removably but securely hold the pad 14 to the backing plate 10. Alternative releasible attachment means may be used such as set-screw or snap-fit arrangements, or a weak adhesive bond that can simply be broken when desired.

The illustrated generally cylindrical disk-shaped pad 14 is formed with an axial forward recess 22 to provide generally concentric radially inner and outer sections 30, 28, and two planar front surfaces 24, 26. The outer surface 24 is for polishing and the inner surface 26 is for cleaning. The illustrated outer polishing surface 24 is formed by the axial forward face of the annular outer pad section 28. The illustrated inner cleaning surface 24 is provided by the front face of a cleaning member or element 15 that is permanently secured within the front recess 20 in front of the inner section 30. This cleaning member 15 may take the form of a natural or synthetic sheepskin or lambswool, a denser, more abrasive foam, a polyester non-woven fabric, or a similar material that accomplishes the same desired cleaning/cutting results. For some applications, the cleaning surface may be provided by the forward surface of inner section 30.

Figure 1:
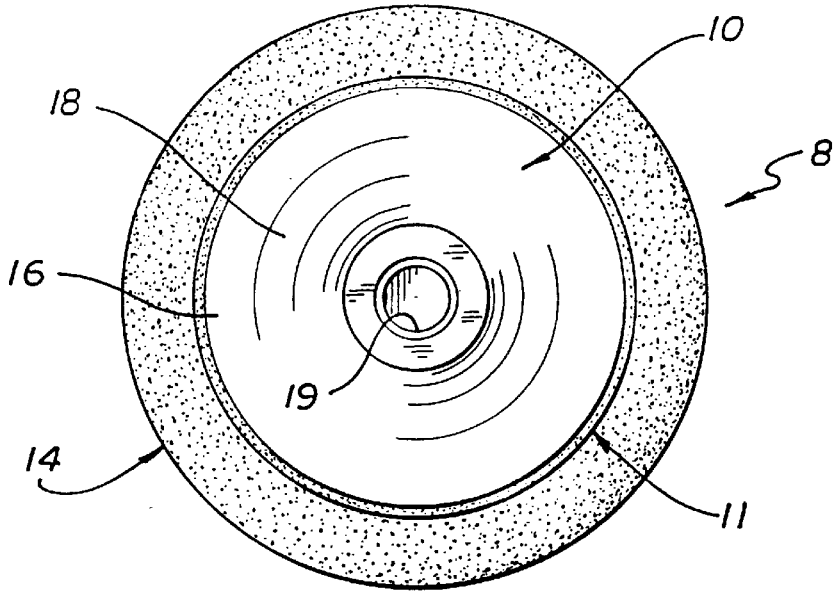
FIG. 1 is a top view of the cleaning/finishing pad and backing plate.
Figure 2:
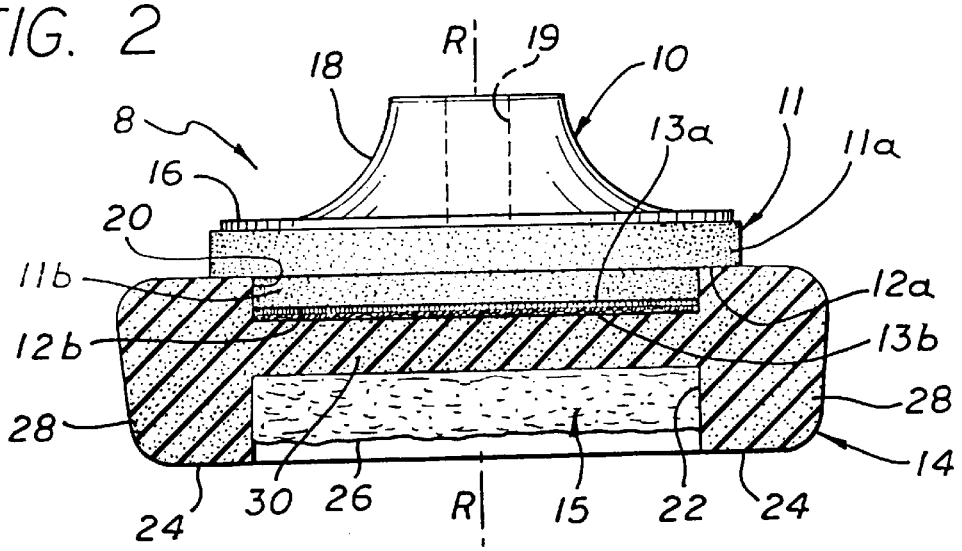
FIG. 2 is a side view of a the cleaning/finishing pad and backing plate.
Figure 3:
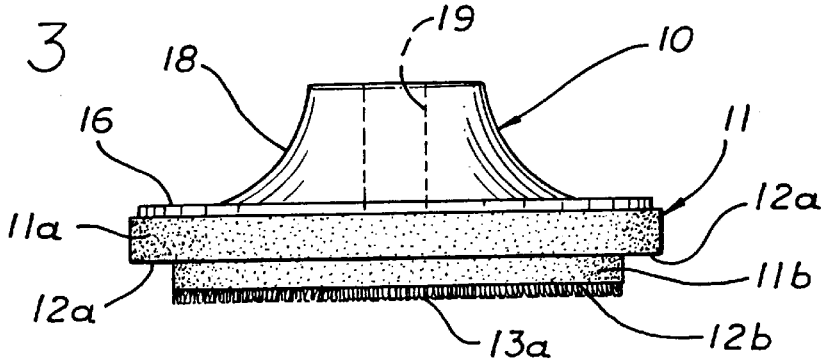
FIG. 3 is a side view of the backing plate.

As noted above, the cleaning surface 26 is normally set back within the recess 22, i.e., positioned somewhat rearwardly of the polishing surface 24 (FIGS. 2 and 4). Only when the outer section 28 is axially compressed will the cleaning surface 26 be shifted forward to general alignment with the polishing surface 24.

As shown in FIGS. 2 and 5, the outer pressure-applying surface 12*a* abuts the rear surface of the compressible radially outer section 28 of the pad for applying selected axial pressure to compress that outer section as desired.

The forwardly facing pressure-applying inner surface 12*b* engages the rear of the radially inner section 30 of the pad across its area so as to apply firm pressure generally uniformly distributed across the cleaning surface 26 on the front of section 30.

It is desirable that the pressure-applying member 11 be of a firm but somewhat resilient material to provide a degree of flexibility in the connection between the pad and the polisher, to facilitate a good, well distributed application of pressure to the cleaning surface 26, as well as being able to apply the necessary axially compressing force to the outer section 28 of the pad.

As noted above, the symmetrical circular cylindrical design of the pad (including its recesses) and the backing plate is preferred as it facilitates smooth balance rotation and operation of the apparatus. Other alternative configurations might be used, however they have more tendency to produce unbalanced and erratic rotation and operation, and are therefore generally less desirable.

Different sizes of pads (along with a matching suitable size backing plate) maybe used, dependent on the surface size or area over which imperfections are to be removed. A common size used for removal of spot imperfections would have an outside foam diameter of approximately 5½" (13.75 cm) with a cleaning surface diameter of approximately 3½" (7.625 com). A common size used for removal of large imperfections would have an outside foam diameter approximately of 7½" (17.5 cm) with a cleaning surface diameter of approximately 5½" (13.75 cm).

Good results have been obtained with a pressure-applying disk about ¾ inch thick, the rear portion being about ¼ inch thick and the front portion being about ½ inch thick.

DETAILED DESCRIPTION OF USE

FIG. 2 shows the cleaning/finishing pad 14 mounted for common rotation on the backing plate 10. Finishing compound may be applied directly to the work surface or to the area of the cleaning surface 26 to be worked on. The pad 14 is then placed directly over that area, and sufficient axial force is applied to compress the outer section 28 and cause the cleaning surface 26 to move to close proximity or engagement with the work surface as shown in FIG. 5. The polisher P maybe turned on, causing the pad 14 to rotate, at any desired time after the pad is brought into contact with the work surface, whether or not the cleaning surface has yet been brought into cleaning contact or had cleaning pressure applied. As described above, the construction of the illustrated apparatus 8, particularly the resilient two-level pressure-applying backing member 11, facilitates a firm steady application of axial pressure through the inner backing portion 11*b* to be directed and maintained against the work surface area by the rotating cleaning surface 26, without excessive axial pressure being applied to the rotating annular polishing surface 24. It will be noted that the friction from the strong cleaning surface contact, reduces the R.P.M. of the pad.

After the work surface area has been sufficiently cleaned, the pressure on the pad 14 is sufficiently reduced to allow the outer section 28 to axially expand. This accomplishes several things. Initially the cleaning surface 26 is separated from the work surface, leaving only the rotating outer foam polishing surface 24 in contact with the work surface. In addition, the remaining finishing compound, in which the abrasive components have been broken-down by the action of the cleaning surface 26, is dispensed radially outwardly from the region in front of the cleaning surface 26 to that in front of the polishing surface 24. The finishing compound at this time contains glazing components for polishing. Still further, as the axial forward pressure on the pad is reduced, friction between pad and work surface is reduced and the R.P.M. of the pad increases, which facilitates the polishing or buffing of the area.

Thus, good results have been achieved with the polisher set for a constant speed of rotation through the cleaning and the polishing operation; as noted, the speed or rotation at the work surface will vary dependent upon the pressure being applied. Further, the pressure is applied generally head-on or at 90 degrees to the work surface, without tilting or angling the polisher. It will be noted that the action of the illustrated pad 14 is due to essentially pure compression of the pad outer-section, rather than involving bending or deflecting of the pad, which could break down or wear out the pad structure.

METHOD OF MANUFACTURE

In accordance with a presently preferred method of manufacturing the pad 14 shown in FIG. 4, initially a foam disc is die cut into a circle. The recesses 22, 24 are created by grinding the front and rear of the disc with a grinding wheel at about 20,000 R.P.M.'s. About a 5 mil acrylic film is used to affix the cleaning member 15 of sheepskin or the like in the recess 22, using a heated platen to melt the acrylic film and permanently affix the sheepskin to the foam of the pad. Next, a loop/hook fastening face 13*b* is affixed in the rear recess 20 using a hot melt film to permanently affix it to the foam of the pad. The finished foam pad 14 is then ground on the outside edges to balance it and add a desirable contour.

The illustrated backing plate 10 is manufactured by first affixing the soft neoprene rubber disk or pressure-applying member 11 to front the face of the base portion 18 of the backing plate 10, using a solvent based glue. After proper drying time, a peripheral portion around the forward edge of the neoprene disk 11 is ground away to create the raised cylindrical inner pressure-applying portion 11*b*. Then a hook/loop fastener face 13*a* is solvent glued to the front face 12*b* of the portion 11*b*.

ALTERNATE EMBODIMENTS

Figure 6:
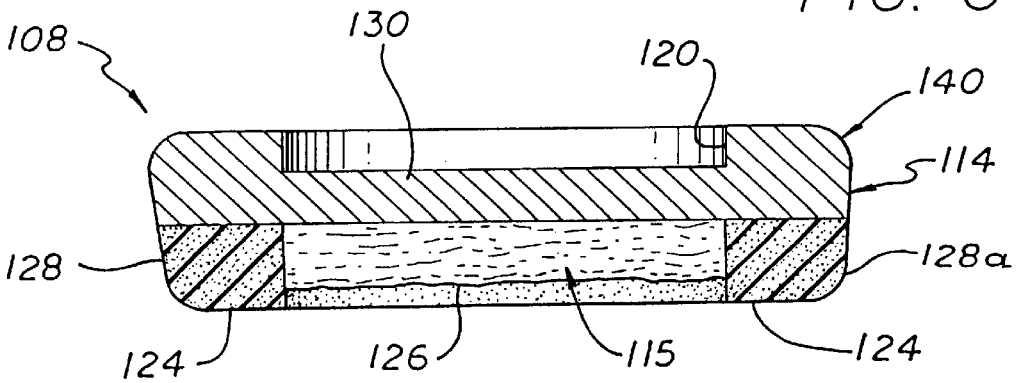
FIG. 6 is a side view of an alternative form of cleaning/finishing pad.

FIG. 6 illustrates an alternative embodiment of the invention in the form of pad 114. Instead of being constructed of a single integrated piece of material as is previously described pad 14, pad 114 is constructed of a plurality of parts or pieces. The overall configuration of pad 114 maybe like that of pad 14.

Pad 114 includes an annular ring 128*a* which provides essentially the forward-half of the radially outer section 128. This outer ring 128*a* provides an annular forward polishing surface 124. The ring 128*a* is made of a compressible expandible material like that of which the pad 14 is constructed. This provides the compression and expansion of the pad 114.

The illustrated annular ring 128*a* is secured at its rear face to the forward face of a generally disk-shaped rear portion 140. The rear portion 140 may be constructed of any suitable material such as molded plastic, metal or the like. The illustrated rear portion 140 provides the radially inner section 130 as well as the rearward halved (approximately) of the radially outer section 124. The rear portion 140 is formed with the rear recess 120 which can receive the pressure-applying front portion 11*b* with the forward facing pressure-applying surface 12*b* in a manner similar to that described with regard to pad 14. Similarly, a cleaning element or member 115 of generally disk-shape may be permanently secured to the front surface of the radially inner section 130. This cleaning member 115 provides at its forward surface the cleaning surface 126.

FIGS. 7 and 8 illustrate another alternative embodiment of the invention in the form of apparatus 208 that comprises pad 214 and backing plate 210. Pad 214 is generally rectangular rather than disk-shaped. Pad 214 is adapted to be moved in a generally linear reciprocating pattern.

Illustrated pad 214 has rear and front central elongated recesses 220, 222 that receive, respectively, a backing portion of a backing plate (not shown) and a cleaning element 215. The recesses 220, 222 define an elongated center inner pad section 230 and a pair of other pad sections 228. The pad 214 is connected by the backing plate to a power tool that provides generally linear reciprocating movement. As with pad 14, forward pressure on the backing plate compresses the outer sections 228 to first bring the inner cleaning surface 226 into position at the work surface. Then, further forward pressure on the backing plate acts through backing portion to apply firm distributed cleaning force at the cleaning surface 226. Subsequently reducing forward pressure allows the outer pad sections 228 to expand to move the cleaning surface 226 rearwardly away from the work surface. Then the outer polishing surfaces 224 may be used to polish the work surface.

Various modifications and changes may be made to the specific illustrated structures and methods without departing from the spirit and scope of the invention as set forth in the following claims.

What is claimed is:

1. A pad for both cleaning and polishing a work surface by virtue of movement of the pad relative to the work surface, the pad having front and rear central inner recesses that define inner and outer pad sections, said front and rear recesses each having a bottom surface, the inner pad section being thinner front-to-rear than the outer section, the inner pad section having a forwardly facing inner cleaning surface that is provided by the bottom surface of the front recess, and a rearwardly facing pressure-receiving inner surface that is provided by the bottom surface of the rear recess, said bottom surfaces being of generally comparable size and being generally aligned with one another, the outer pad section being thicker front-to-rear, being compressible and expandable front-to-rear, and having a forwardly facing polishing surface and a rearwardly facing pressure receiving surface, the outer polishing surface normally being spaced forwardly of the inner cleaning surface, the outer pad section being selectively compressible front-to-rear by initial forward pressure to the rearward pressure-receiving outer surface, when the forward outer cleaning surface is abutted against the working surface, to move the outer cleaning surface into at least close proximity with the work surface, and the inner cleaning surface then being movable into firm distributed cleaning engagement with the work surface by further forward pressure applied by a matting backing member surface across the rearward pressure-receiving inner surface, so that the cleaning surface cleans the work surface as the pad is moved relative to that work surface, the outer section then being selectively expandable by reduction of said forward pressure sufficiently to allow the cleaning surface to disengage from the work surface while the polishing surface engages the work surface to polish the work surface as the pad is moved relative to that work surface.

2. The pad of claim 1 which is generally disk-shaped and has a central axis of rotation.

3. The pad of claim 1 wherein said pad is an integral piece of compressible and expandable material.

4. The pad of claim 3 wherein said material is a foam.

5. The pad of claim 4 wherein said foam is a reticulated polyurethane foam.

6. The pad of claim 4 wherein said foam is a pre-polymer foam.

7. The pad of claim 1 wherein said cleaning surface is provided by a cleaning element permanently affixed to said pad inner section.

8. The pad of claim 7 wherein said cleaning element is a natural or synthetic sheepskin.

9. The pad of claim 7 wherein said cleaning element is a polyester non-woven fabric.

10. The pad of claim 7 wherein said cleaning element is a dense and abrasive foam.

11. The pad of claim 7 wherein said cleaning element is a natural or synthetic lambswool.

12. The pad of claim 1 wherein said rear recess spans across at least a major portion of the pad.

13. The pad of claim 2 wherein said front and rear recesses are generally circular in shape and generally coextensive with one another.

14. The pad of claim 1 in combination with a pressure-applying backing member, said pressure-applying backing member having a inner backing portion configured and proportioned to be removably received in said rear pad recess, said inner backing portion having a forwardly facing generally planar pressure-applying backing surface and said pad rear recess have a mating rearwardly facing generally planar pressure receiving surface.

15. The pad of claim 14 further including a pair of hook and loop fastening sheets secured, respectively, on said pressure-applying surface of the pressure-applying backing member and on said pressure-receiving surface of the pad rear recess for detachable engagement to releasibly retain said pad on said pressure-applying backing member.

16. The pad of claim 14 wherein said pressure-applying backing member is made of a firm, resilient material.

17. The pad of claim 14 in combination with a powered rotary-output tool which is operatively connected to said pressure-applying backing member to impart rotation to said pressure-applying backing member and thus to said pad.

18. A method of manufacturing a disk-shaped foam cleaning/polishing pad that has opposed generally flat circular axially forward and rearward faces, and is designed for rotation about a central axis, the pad being further designed for having a generally flat circular cleaning element attached within a matting circular recess at the axially forward face of the pad, and a pressure plate received within a matting circular recess at the axially rearward face of the pad, said recesses each having a bottom surface, said bottom surfaces being of generally comparable size and being generally aligned with one another, said method comprising the steps of:

1) providing and holding the foam pad in place, 2) grinding a first generally circular recess concentrically in the center of the axially rearward face of the pad, and 3) grinding a second generally circular recess concentrically in the center of the axially forward face of the pad.

19. The method of claim 18 including the further step of permanently attaching a generally flat circular cleaning element within the second recess of said pad.

20. A backing plate for a dual cleaning and finishing pad which is rotatable about a central axis, the pad being compressible under controlled axial forward force to selectively position and maintain a central inner cleaning surface in cleaning engagement with a work surface, the pad being generally disk-shaped with an axially rear generally planar face that has a central circular recess with a bottom wall that spans across at least a major portion of said rear pad face behind the cleaning surface, fastening means being affixed in said recess, the backing plate comprising 1) a base portion for attaching to the output shaft of a rotary power tool for common rotation, 2) a pressure-applying member having axially rear and forward surfaces, the pressure-applying member being permanently affixed to the base portion, the pressure-applying member being made of a relatively softer resilient material, the forward surface of the pressure-applying member being formed with a i) pressure-applying forward directed annular outer surface for abutting and selectively compressing the outer section of the pad, and ii) a circular inner portion with a pressure-applying forward directed inner surface, the forward directed inner surface being spaced forwardly of the forward directed annular outer surface, the inner portion being proportioned and arranged to be received in the rear recess of the pad, with the forward facing planar surface abutting the bottom wall of the pad rear recess and transmitting forward axial pressure against the cleaning surface, and 3) releasible fastening means affixed to said inner portion for releasibly engaging the fastening means in the pad rear recess to fasten the pad to the backing plate.

21. Apparatus for both cleaning and polishing a work surface, using a single pad, said apparatus comprising:

a) a pad having front and rear inner recesses, said recesses defining inner and outer pad sections, each pad section having forward and rearward surfaces, the inner pad section being thinner rear-to-front and having forward facing inner cleaning surface at its front surface, the outer pad section being thicker rear-to-front, being compressible and expandable rear-to-front, and having a forward facing outer polishing surface at its front surface, the outer polishing surface normally being spaced forwardly of the inner cleaning surface, b) a pressure-applying backing member attached to the pad so as to exert desired pressure on the pad, said pressure-applying backing member comprising:

an outer backing portion having an outer pressure-applying backing surface for selectively applying forward pressure to the rearward surface of the pad outer section to compress that pad outer section and thereby move the cleaning surface into at least close proximity to the work surface, and an inner backing portion having an inner pressure-applying backing surface, said inner backing portion projecting forwardly of said outer backing portion and being received in said pad rear recess with said inner pressure-applying backing surface abutting the pad inner section for selectively applying desired forward firm distributed cleaning pressure to the cleaning surface after the cleaning surface has been moved to said at least close proximity to the work surface, and c) fastening means on said pad and on said pressure-applying backing member for releasibly attaching them together for common movement.

22. The apparatus of claim 24 wherein said pressure-applying member is made of a resilient material.

23. The apparatus of claim 22 wherein said pressure-applying member is made of a relatively soft neoprene.

24. The apparatus of claim 23 further including power means connected to said pressure-applying member to move said backing member and said pad.

25. The apparatus of claim 21 wherein said pad and said backing member are each generally disk-shaped and rotatable about a central rear-to-front axis.

* * * * *